United States Patent [19]

Whalley

[11] Patent Number: 4,516,712

[45] Date of Patent: May 14, 1985

[54] CUTTING DEVICES FOR TILES

[76] Inventor: Leslie A. Whalley, 109 College Rd., Norwich, England, NR2 3JP

[21] Appl. No.: 480,891

[22] Filed: Mar. 31, 1983

[30] Foreign Application Priority Data

Dec. 31, 1982 [GB] United Kingdom ..... 8237084

[51] Int. Cl.[3] ..... B26F 3/00

[52] U.S. Cl. ..... 225/96.5; 125/23 R

[58] Field of Search ..... 225/96.5, 2; 125/23 R, 125/23 T

[56] References Cited

U.S. PATENT DOCUMENTS

| | | | |
|---|---|---|---|
| 662,924 | 12/1900 | Dugon | 225/96.5 |
| 2,146,883 | 2/1939 | Clausen | 225/96.5 |
| 2,638,022 | 5/1953 | Reyes | 225/96.5 X |
| 3,739,966 | 6/1973 | Lynn | 225/96.5 X |

FOREIGN PATENT DOCUMENTS

| | | | |
|---|---|---|---|
| 956179 | 9/1982 | U.S.S.R. | 225/96.5 |

*Primary Examiner*—Frank T. Yost

*Attorney, Agent, or Firm*—Nelson E. Kimmelman

[57] ABSTRACT

A tile cutter for separating into parts a ceramic tile or the like after scoring a break line, comprised of a pair of blocks hinged by stop hinges and having proximate edge faces cut away to provide clearance for folding the blocks about the hinge. Slots extend through the blocks and are normally coplanar to admit a tile so as to bridge the gap between the two blocks. A stop which may be adjustable towards and away from the hinge, governs the amount by which a tile can be introduced into the aligned slots. Alternatively the tile may be held in position through a cut-out. A scale allows the amount of insertion to be measured. A scribing tool is used to scribe a line in the tile surface to define the break line and the tile is cut (or broken) by sharply hinging one of the two blocks relative to the other as by a sharp impact, so as to stress the tile along the tile scribed line to cut/break the tile therealong.

9 Claims, 9 Drawing Figures

CUTTING DEVICES FOR TILES

FIELD OF THE INVENTION

This invention relates to a tile cutter, more especially for cutting, trimming, snapping or breaking, in a controlled manner, but also has applicability to cutting other brittle sheet material such as glass. Accordingly references herein to a "tile cutter" should be understood to refer to a cutting device primarily intended for cutting, or controllably breaking tiles but also being usable for cutting or controllably breaking analogous brittle sheets.

BACKGROUND TO THE INVENTION

Normally, glazed ceramic tiles are cut by the steps of measuring the tile to the section required, scribing the glazed surface in accordance with the measurement, and snapping the tile, expectantly along the scribed line, by exerting a folding pressure between the two sections on opposite sides of the said line.

This known procedure is open to errors of measurement, errors or faults in scribing and incorrect snapping which deviates from the scribed line, any and all of which result in tile wastage, especially when tiles are being handled by a relatively unskilled person.

OBJECT OF THE INVENTION

It is an object of this invention to provide a cutting device, especially suitable for cutting and breaking glazed ceramic tiles in a controlled manner which device can be readily and inexpensively manufactured and is simple to use, even by the unskilled person, and is efficient in operation for the purpose of substantially reducing tile wastage.

THE INVENTION

According to the invention, there is provided a tile cutter which comprises first and second blocks having proximate edge faces at which the two blocks are hinged together, slots which are coplanar in one position of the two relatively hinged blocks and which then extend through said two blocks in a plane parallel to and at least passing close to the hinge axis, whereby a tile can be inserted through the slot in the second block and past the proximate edge faces to enter the slot in the first block, and means enabling positioning of an inserted tile so that the two blocks can subsequently be folded to snap the tile at a scribed line thereon which is located substantially in line with the hinge axis at the proximate edge faces.

FURTHER FEATURES

Preferably, the proximate edge faces of the two blocks have regions which are in substantially abutting relationship, and said edge faces are cut away on one side of the plane in which the slots are coplanar. This enables a scribed line on an inserted tile to be seen or more commonly, the line to be scribed, through the elongate recess formed by the cut away portions of the edge faces, after the tile has been inserted and correctly positioned.

In one embodiment the positioning enabling means comprises a stop means interrupting the slot in the first block.

Thus, the stop means will preferably be adjustable, towards or away from the hinged joint between the two blocks, so that a line can be scribed in a chosen position set by a scale associated with the adjustable stop means.

In another embodiment, the position enabling means comprises at least one cut-out in the first block on one side of the slot therein, enabling an inserted tile to be seen and positioned.

The cut-out or cut-outs enable the inserted tile both to be initially positioned and maintained in position with the fingers when the blocks are folded.

When the blocks substantially abut at the hinged joint, the edge faces will be angled away from one another on one side of the hinge axis, in order to provide clearance for the blocks to be folded.

The two blocks will preferably be connected by spring means which normally urges them into the unfolded condition in which the slots are in coplanar relationship ready for insertion of a tile. This spring means may be housed in a recess, in the blocks if desired, and will preferably be a tension spring acting between the blocks to the side of the hinge axis opposite to the side on which the edge faces are angled away from one another.

The first block having the positioning enabling means can be a larger and more substantial block than the second block, and in particular may have a larger dimension (thickness) than the second block in the direction normal to the slot therein. This enables the first block to be held down on the flat of the table, and the second block to be folded, at least to the extent necessary to snap a scribed tile, without the necessity to position the second block so that it overhangs the table edge.

Alternatively the blocks may each be provided with a pair of feet at or adjacent the outer corners remote from the hinge joint, and the hinge is formed by a hinge means projecting below the blocks to the same level as the feet.

The hinge means thus constitutes supplementary feet for supporting the blocks with the slots therein in coplanar relationship.

The second block may conveniently be provided with a clamping means, e.g. a screw threaded pin and associated clamping plate in the slot, which in can be screwed into the block, as by an exposed finger grip, to cause the clamping plate to clamp an inserted tile in a properly located position.

Preferably, the side wall of the slot, in at least one of the blocks, is provided with a leaf spring for resilient positioning of an inserted tile in the lateral direction transverse to its direction of insertion.

The blocks may be made of any convenient material, but often wood will be preferred. Whatever the block material, it will be preferred to provide at least the second block with a steel insert adjacent its edge face, for the purpose of protecting the cutting edge of a scriber. Furthermore, the face of the clamping plate which is to press on the tile, usually on the glazed surface thereof, will preferably be lined with a layer of rubber or plastics material such as P.V.C.

The device can also readily be adapted to handle tiles of different sizes i.e. widths and thicknesses and it is a further object of the present invention to provide such a tile cutting and trimming device which can handle tiles of at least two different sizes.

According to this aspect of the present invention a tile cutter or tile trimmer comprises:

(1) a first slotted member into and through which a tile can be introduced;

(2) a second slotted member hingedly joined to the first said member and movable into relation with the first said member so that the slots in the two said members are coplanar, the slot in the second said member being capable of receiving the protruding portion of a tile which has been pushed through the slot in the first said member;

(3) at least the second said member being formed from a baseplate to which the first said member is hingedly attached and a removable coverplate which can be fitted either way up on the baseplate and which includes differently dimensioned cutaway regions on its upper and lower faces, the lower facing one adjacent the hinge at any time cooperating with the baseplate to form the slot in the second said member whereby the size of the slot in the second said member can be altered by removing the said coverplate and repositioning and securing it in place with another cutaway region opposite the baseplate adjoining the hinge.

In a preferred embodiment a cutaway region in one face is wider than that in the other face so that different widths of tile can be accommodated.

In another embodiment each of the cutaway regions is formed in two sections so that either four different tile widths and thicknesses can be accommodated.

The removable coverplate may be held in place by screws or quick release fastenings or clips.

DESCRIPTION OF EMBODIMENT

Figure 1:
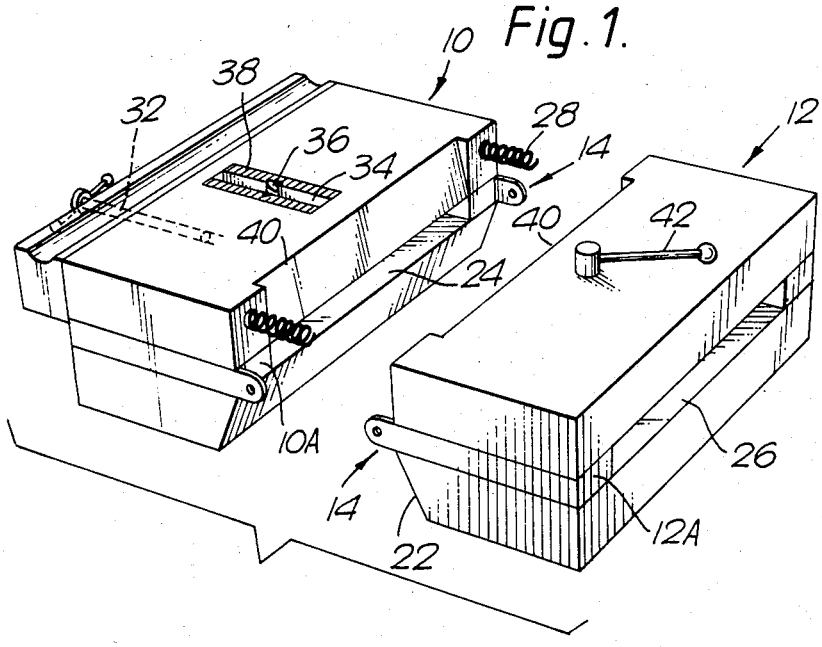
FIG. 1 is a diagrammatic, exploded, perspective view of one embodiment of cutting device.
Figure 2:
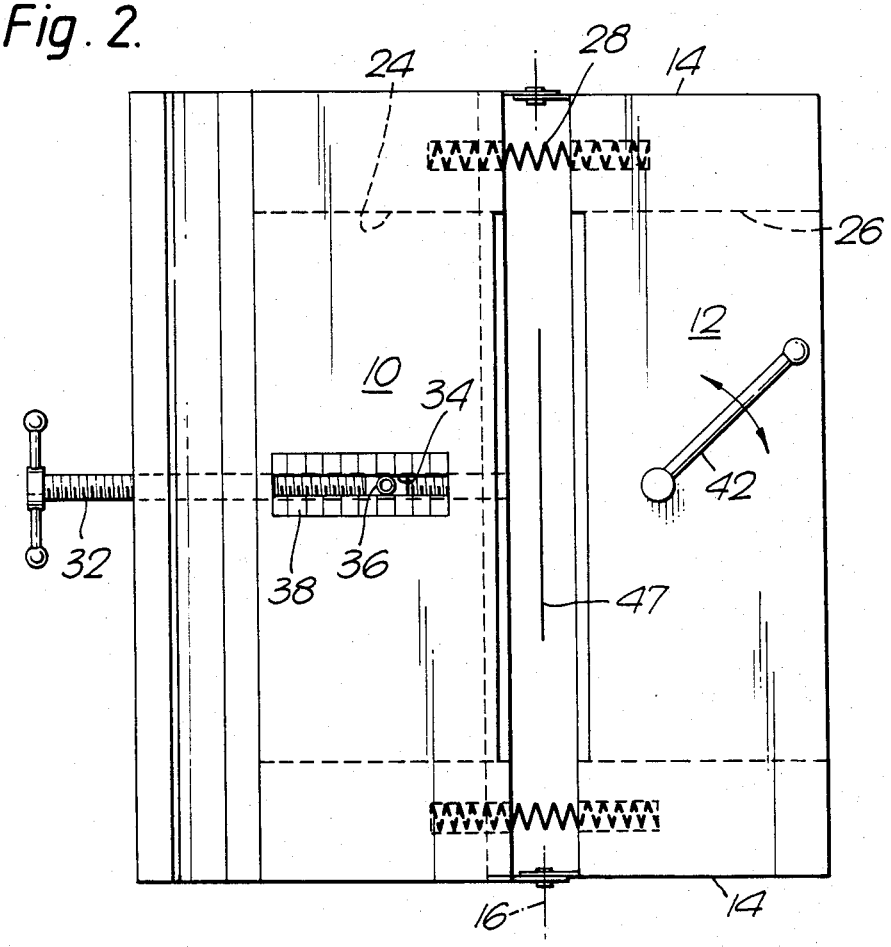
FIG. 2 is a plan view thereof.
Figure 3:
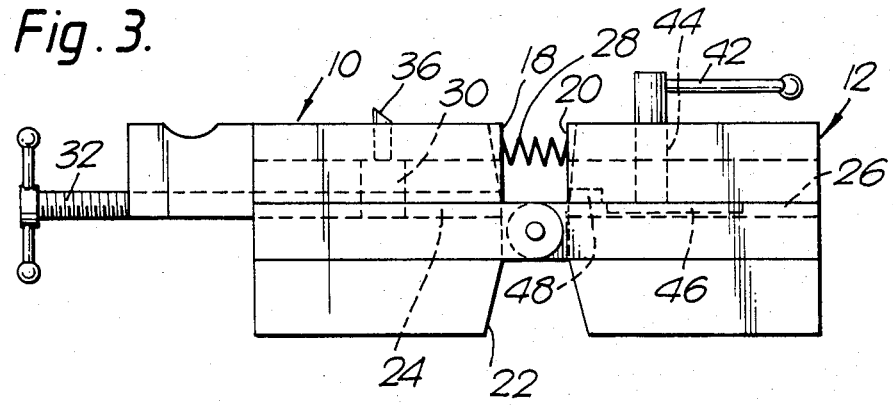
FIG. 3 is a side elevational view.

In FIG. 1, reference 10 generally denotes a first block and reference 12 generally denotes a second block. The blocks 10, 12 are hinged together by means of strap hinges 14 on opposite sides of the device, defining a hinge axis 16 (see FIG. 2) disposed between two proximate edge faces 18, 20 of the two blocks, which faces have regions in close to abutting relationship. Thus, on the scale of the blocks 10, 12 below the hinge 16, the edge faces 18, 20 are angled away from one another, as indicated at 22 in FIGS. 1 and 3, in order to provide clearance for folding of the blocks about the hinge.

Slots 24, 26, normally in coplanar relationship, extend through the blocks 10, 12 from front to back in a plane parallel to and intersecting the hinge axis 16. In practice, each such slot may be defined between two partial blocks bonded together through intermediate spacers 10A, 12A to form the slotted blocks 10, 12 (see FIG. 3). Tension springs 28 normally hold the blocks 10, 12 in the unfolded condition in which the slots 24, 26 are coplanar, ready for insertion, from the front, of a tile to be cut.

The first or rear block 10 carries a stop means which interrupts the slot 24. This stop means conveniently comprises a stop member 30 (see FIG. 3), slidable in a tunnel cut in the block, towards or away from the hinge 16, under the drive of a finger screw 32 projecting from the rear of the said first block. A reduced width upward extension of the tunnel forms a slot 34 along which is movable an index finger 36 cooperates with a graduated scale 38 provided on the upper surface of the first block 10.

In use the stop member 30 can be adjusted, using the cooperating scale 38 and cooperating index finger 36, to locate the leading edge of a tile inserted through the blocks from the front. A reading (X) on the scale will set the stop member so that a line across the tile in line with the hinge 16 is a distance (X) from the leading edge of the tile. It is on this line that the tile is to be scribed ready for breakage.

In order to enable scribing, the proximate edge faces 18, 20 of the two blocks 10, 12 are cut away above the hinge 16, as indicated at 40, to enable insertion of the scribing head of a scriber. Although not shown, a suitable scribing tool may be mounted to one of the blocks for sliding along a rail extending across the block adjacent the scribing slot defined by the opposed cut away portions of the two blocks.

In use, a tile will be inserted, glazed surface uppermost, through the slot in the second block and into the slot in the first block as far as permitted by the adjusted stop member. Clamping means is provided on the second block 12 to clamp the tile in this desired location. Such clamping means comprises a clamp arm 42 rotatable to drive a screw threaded pin 44 into the block 12 in order to depress a clamping plate 46, located within the slot 26, into engagement with the tile. The face of the clamping plate will in practise be lined with rubber or a plastics material such as P.V.C.

The tile may now be scribed, as indicated at 47, and then, by folding the two blocks 10, 12 about the hinge 14, snapped at the scribed line. For this purpose, the first block 10 may be held down on a table or workbench with the second block overhanging the edge. Preferably, however, although not shown, the first block 10 will be sufficiently thicker than the second block 12 that the latter block can be sufficiently folded to snap the tile when the device is positioned on a table away from the edge thereof.

Conveniently, the blocks 10, 12 may be of wood, in which case a steel insert 48 is provided at the edge face 18 of the first block or a similar insert may be inserted at the face 20 of the second block, in order to protect the cutting edge of the scriber.

Viewed from the front, the tile-receiving slot 26 in the second block 12, and likewise the slot 24 in the first block 10, will be wide enough to receive a standard size ceramic tile with clearance. Likewise the slots 24, 26, as restricted by the stop means, will permit the tile to be inserted to an adjustable extent enabling a range of tile sections to be cut from a relatively narrow strip up to a half tile.

Figure 4:
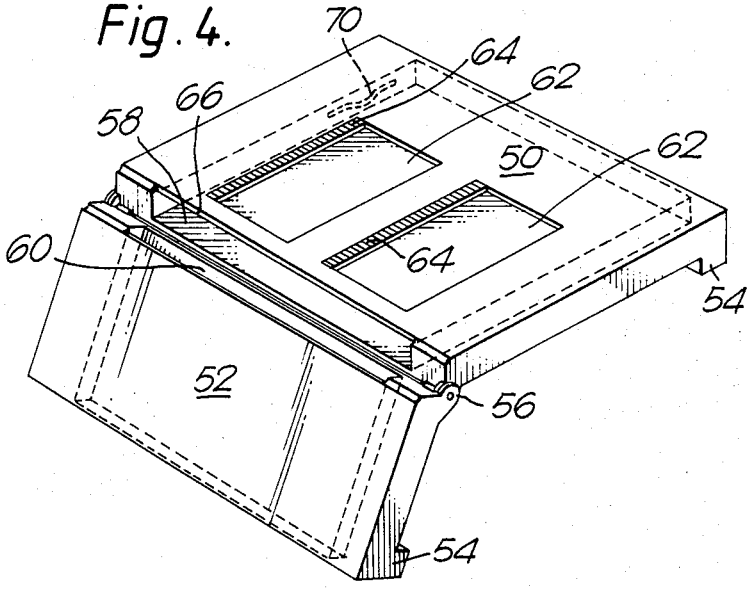
FIG. 4 is a perspective view of an alternative embodiment.
Figure 5:
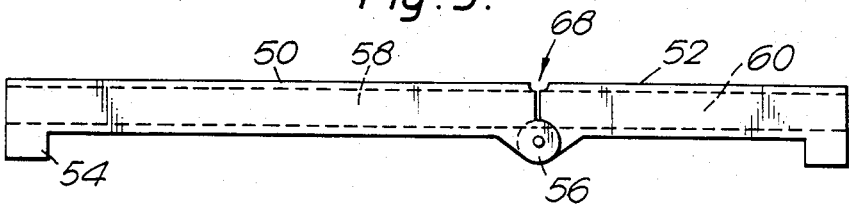
FIG. 5 is a side elevational view thereof.
Figure 6:
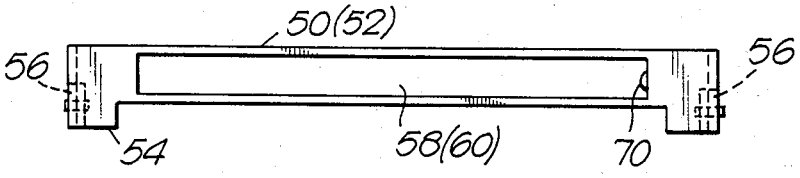
FIG. 6 is an end elevational view.

FIGS. 4 to 6 show a simpler embodiment comprising first and second blocks 50, 52, of smaller depth than in the outer corners 54.

The blocks 50, 52 are hinged by a hinge means 56 which projects to the same depth below the blocks (in the coplanar relationship thereof) as the feet. The hinge means 56 form supplementary feet supporting the blocks with the tile insert slots 58, 60 in coplanar relationship when the device is placed on a flat surface.

The stop means and clamping means are omitted, in addition to the spring coupling between the blocks. Instead, an inserted tile is positioned, and held in position with the fingers during folding of the second block 52 relative to the first block 50, through a pair of rectangular cut-outs 62 in the first block. A measuring scale 64 is provided along one edge of each cut-out, parallel to the direction of tile insertion.

A steel insert 66 for protection of a scriber point is provided along one side of a recess 68, above the hinge axis at the edges of the adjacent upper surfaces of the two blocks 50, 52, which recess enables an inserted and positioned tile to be scribed prior to cutting or trimming by folding the blocks.

In addition it will be seen that the metal insert such as 66 will not only protect the scriber but will also prevent wear of the relatively soft material from which the block will normally be made.

Also, as indicated in FIG. 4, at least one side wall of the tile insert slot 58 in the first block 50 is provided with a leaf spring 70 for biassing an inserted tile laterally and thereby effecting resilient positioning thereof in the lateral direction of tile insertion.

The provision of two windows (62), as shown in FIG. 4, permits the user to press down on the tile using two fingers during scribing of the tile and folding of the second half of the device to break the tile.

Although the alternative embodiment of FIGS. 4 to 6 is primarily intended to be a simpler and less expensive arrangement, it will be apparent that a stop means and/or clamping device and/or coupling spring may be added to the arrangement, if desired.

Figure 7:
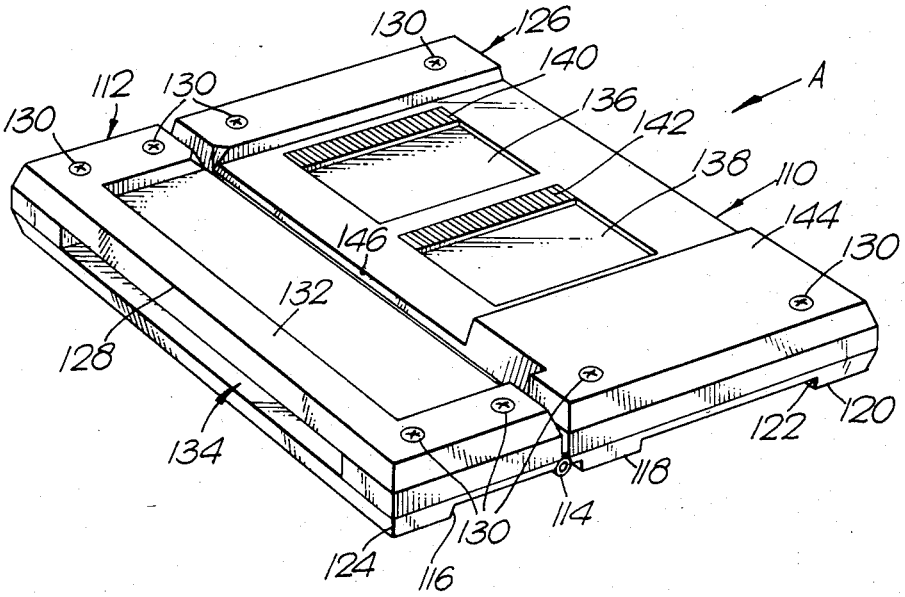
FIG. 7 is a perspective view of a further embodiment of tile trimmer.
Figure 8:
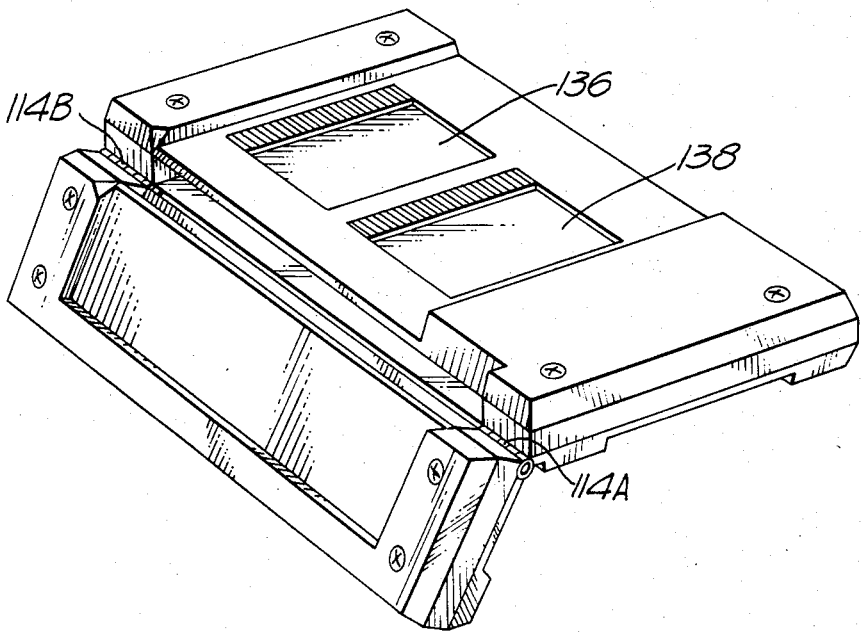
FIG. 8 shows how the parts on the trimmer hinge relative to one another.

In the further embodiment shown in FIGS. 7 and 8, the improved trimmer comprises a large tile receiving slotted member 110 and a smaller slotted member 112. The two members are hinged at 114 and allow the assembled unit to stand square on a flat surface. As shown in FIG. 8 the hinge may be found in two aligned sections 114A and 114B.

Each member 110, 112 is formed from a baseplate 122, 124 respectively and by a removeable coverplate 126, 128 respectively, the coverplates being secured to their respective baseplates by means of screws 130.

Each coverplate includes thicker peripheral regions such as 132 and reduced thickness central regions and in particular coverplate 126 is cut away on both the top and the bottom so that, depending on which way up it is fitted on the baseplate 122, so a slot of given size is formed between the coverplate 126 and the baseplate 122. Thus the underside of the coverplate 128 is cut away in like manner to the top so that when fitted over the baseplate 124 it will likewise form a slot as shown at 134.

The coverplate 126 is apertured at 136 and 138 to provide windows through which the edge of a tile can be seen (the tile having been pushed through the aligned slots in the two sections one of which is shown at 134). Likewise the windows will allow the user to insert two fingers into contact with the tile to assist in holding it in place while scoring and/or breaking.

Each window 136, 138 includes a scale as at 140 and 142.

The peripheral side region 144 of coverplate 126 is wider than the opposite side regions thereof, so that when this is inverted relative to the position shown in FIGS. 7 and 8, the slot width formed in the larger section 110 will be reduced.

Figure 9:
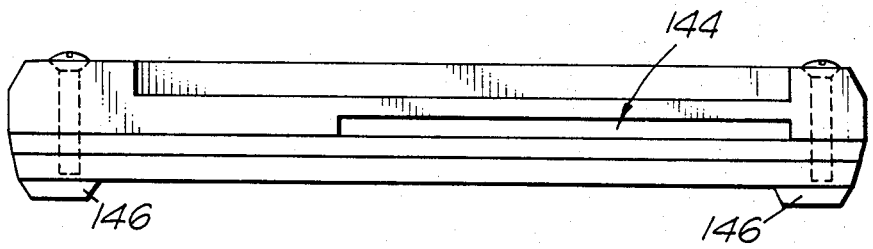
FIG. 9 shows the different width slot obtainable by inverting an upper cover plate on one of the two parts.

FIG. 9 demonstrates how this is achieved, by an end view of the device shown in FIG. 7 taken in the direction of the arrow A. The slot into which the tile is fitted is indicated by reference numeral 144.

To assist in keeping the unit stationery when in use, rubber feet or the like may be fitted to the underside as at 146.

The gap 146 between the two units allows a scoring tool to be inserted to score an inserted tile, to allow it to be broken by locating the unit at the edge of a table to allow the left hand section 112 to be knocked down relative to the section 110, to break the tile along the score line.

It will be appreciated that the above described arrangements are described by way of example and may be modified in various ways within the scope of the invention as hereinbefore defined, equally if the cutting device is designed to be adaptable for cutting tiles of differing standard sizes or even other brittle sheet materials.

I claim:

1. A tile cutter comprising first and second blocks having proximate edge faces at which the two blocks are hinged together, respective slots in said blocks which are coplanar in one position of the relatively hinged blocks and which then extend through said two blocks in a plane parallel to and at least passing close to the hinge axis, whereby a tile can be inserted through the slot in the second block and past the proximate edge faces to enter the slot in the first block, means enabling an inserted tile to be positioned so that the two blocks can subsequently be folded to snap the tile at a scribed line thereon, said proximate edge faces having regions which are in substantially abutting relationship, and said edge faces also being cut away on one side of the slots.

2. A tile cutter according to claim 1 in which the position enabling means comprises a stop means interrupting the slot in the first block, said stop means being adjustable towards or away from the hinged joint between the two blocks.

3. A tile cutter according to claim 1, including a tile positioning scale associated with the position enabling means.

4. A tile cutter according to claim 1 including spring means by which the two blocks are connected normally to urge them into an unfolded condition in which the slots are in coplanar relationship ready for insertion of a tile, said spring means being housed in a recess in the blocks on the side of the hinge axis opposite to the side on which the edge faces are cut away from one another.

5. A tile cutter according to claim 1, in which the slot in at least one of the blocks is provided with means for urging an inserted tile in the lateral direction transverse to its direction of insertion.

6. A tile cutter comprising first and second blocks having proximate edge faces at which the two blocks are hinged together, respective slots in said blocks which are coplanar in one position of the relatively hinged blocks and which then extend through said two blocks in a plane parallel to and at least passing close to the hinge axis, whereby a tile can be inserted through the slot in the second block and past the proximate edge faces to enter the slot in the first block, means enabling an inserted tile to be positioned so that the two blocks can subsequently be folded to snap the tile at a scribed line thereon, said position enabling means comprising at least one window cut out in the first block on one side of the slot therein, enabling an inserted tile to be seen and positioned.

7. A tile cutter comprising first and second blocks having proximate edge faces at which the two blocks are hinged together, respective slots in said blocks which are coplanar in one position of the relatively hinged blocks and which then extend through said two blocks in a plane parallel to and at least passing close to the hinge axis, whereby a tile can be inserted through the slot in the second block and past the proximate edge faces to enter the slot in the first block, means enabling an inserted tile to be positioned so that the two blocks can subsequently be folded to snap the tile at a scribed line thereon, and further including clamping means in said second block to clamp an inserted tile in a properly located position.

8. A tile cutter comprising first and second blocks having proximate edge faces at which the two blocks are hinged together, respective slots in said blocks which are coplanar in one position of the relatively hinged blocks and which then extend through said two blocks in a plane parallel to and at least passing close to the hinge axis, whereby a tile can be inserted through the slot in the second block and past the proximate edge faces to enter the slot in the first block, means enabling an inserted tile to be positioned so that the two blocks can subsequently be folded to snap the tile at a scribed line thereon, and further wherein at least the second block comprises a base plate and a cover therefor which define the corresponding slot between them, the cover being positionable relative to the base in alternative positions which define the corresponding slot with dimensions suited to alternative sizes of tiles.

9. A tile cutter according to claim 8, having differently sized cut outs in the top and bottom surfaces of said cover, and means for fixing the cover to the base in either one position or an inverted position.

* * * * *